United States Patent [19]

Liu

[11] 4,208,137

[45] Jun. 17, 1980

[54] POSITION SENSING FOR MATRIX PRINTER

[75] Inventor: Chih H. Liu, San Jose, Calif.

[73] Assignee: NCR Corporation, Dayton, Ohio

[21] Appl. No.: 869,890

[22] Filed: Jan. 16, 1978

[51] Int. Cl.[2] ..... B41J 3/12; B41J 19/14

[52] U.S. Cl. ..... 400/124; 400/322; 400/323; 400/342; 101/93.05

[58] Field of Search ..... 101/93.05, 93.04; 364/900 MS File; 400/124, 126, 322, 320, 323, 342

[56] References Cited

U.S. PATENT DOCUMENTS

| | | | |
|---|---|---|---|
| 3,833,891 | 9/1974 | Howard et al. | 364/900 |
| 3,941,051 | 3/1976 | Barrus et al. | 400/121 X |
| 3,993,181 | 11/1976 | Potma et al. | 400/124 |
| 3,999,644 | 12/1976 | Pape et al. | 101/93.05 X |
| 4,024,506 | 5/1977 | Spaargaren | 364/900 |
| 4,116,567 | 9/1978 | San Pietro | 400/124 |

FOREIGN PATENT DOCUMENTS

| | | | |
|---|---|---|---|
| 2516835 | 10/1976 | Fed. Rep. of Germany | 400/124 |

*Primary Examiner*—Paul T. Sewell
*Attorney, Agent, or Firm*—J. T. Cavender; Wilbert Hawk, Jr.; George J. Muckenthaler

[57] ABSTRACT

An alternating current coupled dot column sensing circuit provides delayed dot position signals for control logic of a matrix printer to actuate the printing elements at the proper dot column positions in bi-directional printing. A sensor recognizes edges of slots in a timing strip across the printer and also recognizes end or home positions of the strip for use in such printing.

13 Claims, 7 Drawing Figures

POSITION SENSING FOR MATRIX PRINTER

BACKGROUND OF THE INVENTION

In the field of matrix printers it is of course well known that a printer may include one or more print heads which are caused to be moved in a reciprocating manner across the printer for printing in serial manner. The print head may be moved by a cable and pulley arrangement, a lead screw, or a cam drive or like drive mechanism. Each of the print heads includes a plurality of elements supported in group-like manner and actuated or energized at high speed to cause printing of dots by movement of dot-making elements including droplets of ink or print wires attached to solenoids and caused to be impacted against the paper. The print wires or ink jet nozzles are usually closely spaced in vertical manner so as to print the dots making up the characters in a line as the print heads are moved across the printer. In this manner, a line of printed characters is completed upon travel of the print head in one direction across the paper.

Another form of matrix printer includes the use of a plurality of printing elements supported from a carriage in a manner wherein the elements are aligned horizontally across the printer and upon each pass of the carriage respective dots of characters are printed in a line or row and subsequent passes of the carriage and printing elements cause additional lines of dots to be printed to complete the dot matrix characters along the line of printing. Common arrangements include the use of four or eight printing elements supported from the carriage.

A timing strip with slots or like indicia is commonly used to originate the actuation of the printing elements wherein one or more sensors sense the slots or other indicia to print dots in precise columns across the paper. While the printing has usually been performed in one direction, for example, left to right, it is more recently that printing has been done in both directions of travel of the print head carriage or of the printing element carriage.

Representative or typical prior art dealing with a device for feeding a print head is shown in U.S. Pat. No. 3,858,702 issued to N. Azuma on Jan. 7, 1975 wherein printing is performed in the left to right direction and non-contact switches positioned at right and left ends of the printer and operable with a shutter make up limit switches which change state for reversal of direction of the print head.

U.S. Pat. No. 3,858,703 issued to H. Duley on Jan. 7, 1975 discloses a bi-directional dual head printer which uses a registration strip with a plurality of equally-spaced narrow transparent slots and wherein each print head prints a portion of the line of characters in a mode of printing wherein every other line is printed as the print heads move from left to right and printing the interspersed lines as the print heads move from right to left.

U.S. Pat. No. 3,970,183 issued to P. Robinson et al. on July 20, 1976 shows a printer capable of printing in either forward or reverse direction and monitoring is performed by detecting both the direction of head movement and print head position at any time during the operation. The information is detected by a pair of optical channels and a registration strip has displaced sets of transparent slots therein.

SUMMARY OF THE INVENTION

The present invention relates to a matrix printer and more particularly to a sensing circuit which provides dot position signals for the printer control logic to actuate the printer printing elements at precise times. A plurality of printing elements are carried as a group and driven in a reciprocating manner across the printer and printing is accomplished in each direction as the printing elements are caused to be driven in the above manner. Since each dot of the printed characters must be deposited or positioned at the same column location for that particular dot in each direction of printing and by reason of the response time of the printing element from time of actuation until impact of the ink droplet or print wire against the paper certain delay times must be incorporated into the circuitry. When a pulse or signal is generated in the printer timing for a particular dot to be printed, the time for actuating the printing element is delayed until the exact instant equal to the response time of the printing element prior to the dot column position.

The starting and stopping of the motor which drives the print head carriage and the speed of the motor during travel of the carriage across the printer are associated with the firing of the printing elements in each direction of travel. The motor control circuitry provides for speed regulation, motor starting, motor stopping, and motor jam indication.

The dot and home position sensing scheme includes a double mask sensor, an operational amplifier, a timing strip and a plurality of transistors, the sensor being termed an alternating current coupled dot column sensor and wherein the circuit provides delayed dot position signals for the printer control logic to fire the printing elements at the proper dot column positions. The dot position signal is a symmetrical square waveform which corresponds to the timing strip pattern interrupting the double mask sensor. An adjustable time delay of from 95 microseconds to 195 microseconds is provided by the circuit for aligning the dot column in each direction of printing. At one end of the timing strip a window area, designated as HOME 1 position, and at the other end of the timing strip a web area, designated as HOME 2 position, are recognized by the printer control logic as the turn around points for the carriage and the printing elements.

The speed regulation scheme is termed a back electromotive force direct current motor speed control wherein circuitry includes a feedback operational amplifier, a power transistor and a load current sensing device.

The motor is started by use of a junction field effect transistor which is controlled by another transistor and wherein the motor starting time is approximately 50 milliseconds.

Dynamic braking of the motor is accomplished by use of a diode and transistor combination and wherein the back electromotive force of the running motor acts to bring the motor to a full stop within 100 milliseconds.

A motor jam warning is provided by a detector device whenever the armature current exceeds a normal loading for longer than a predetermined time, there being a delay circuit for recognizing short-term overloads of the motor.

In view of the above discussion, the principal object of the present invention is to provide a device for sensing matrix dot and home positions in a printer.

An additional object of the present invention is to provide a sensing circuit which provides dot position signals for printer control logic to actuate the printing elements at precise dot column locations.

Another object of the present invention is to provide a coupling circuit which is independent of the distance variation between the timing strip and the sensing device.

A further object of the present invention is to provide delay circuitry which decreases noise or electromagnetic interference susceptibility.

Another object of the present invention is to provide delay circuitry which compensates for response time of the printing elements.

Additional advantages and features of the present invention will become apparent and fully understood from a reading of the following specification taken together with the annexed drawing.

DESCRIPTION OF THE PREFERRED EMBODIMENT

Figure 1:
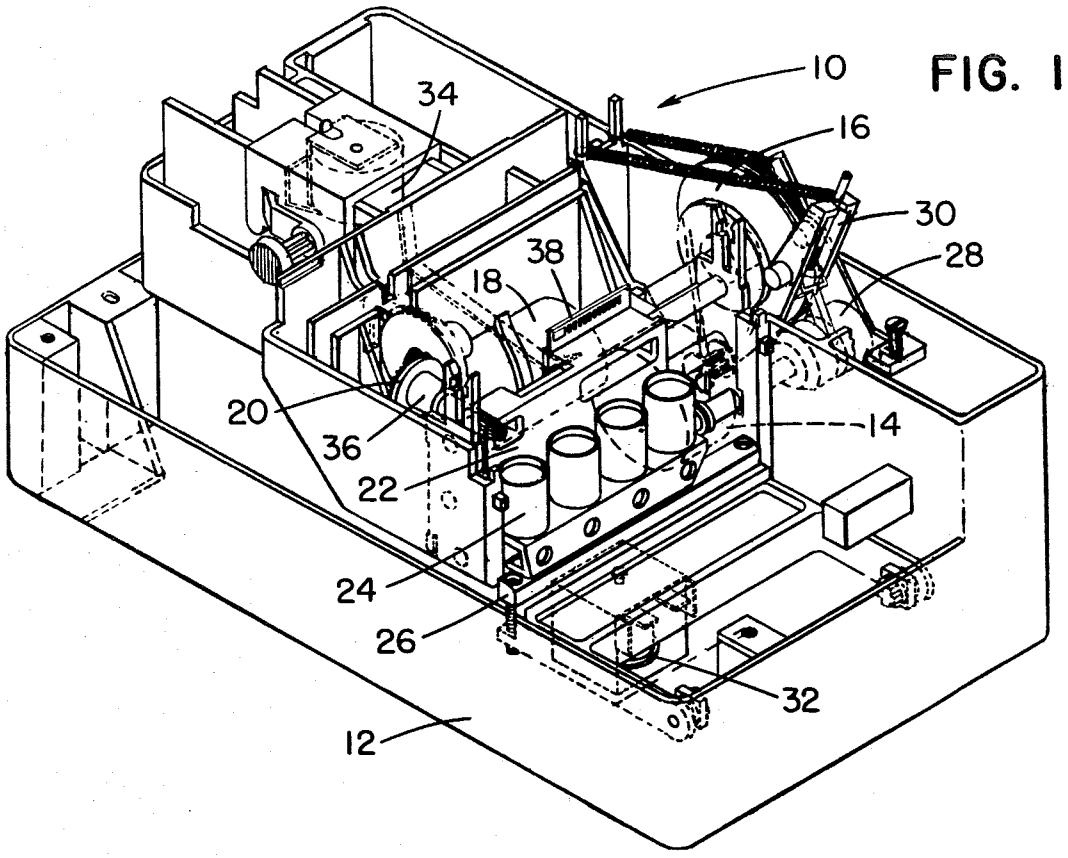
FIG. 1 is a left front perspective view of a matrix printer utilizing the subject matter of the present invention.

Referring now to FIG. 1 there is shown a printer of the matrix type generally designated as 10, the top cover or portion thereof being removed to illustrate certain of the interior working parts which are contained within an enclosure 12 which assumes a rectangular shape and provides mechanical protection for a compact high speed printer. Specifically, the printer is an alpha-numeric single printing element electronic recorder which utilizes a control system adaptable for a family of printers performing various functions. A drive motor 14 is positioned to drive a cluster of gears 16, a drum-type cam 18 and a bevel gear 20 for driving a ribbon in continuous manner past the printing station. The drum cam 18 is continuously driven by the motor 14 and provides side-to-side drive or movement for a print carriage 22 drivingly connected with a rail of the cam and which carries a plurality of printing elements 24 for printing in a dot matrix manner on printing paper or like form which is caused to be moved across a platen 26, such platen being in the shape of a flat bar disposed laterally across the printer. The printing elements 24, hereinafter described in the preferred embodiment of the present invention as single wire solenoid driven elements, are aligned in a row and are caused to be moved a distance of approximately 0.6–0.7 inch during the printing operation, which includes printing in each direction of movement or travel of the printing carriage 22.

At the end of each line of printing, the paper is caused to be moved by an incremental dot feed arm 28 wherein in the case of a seven dot height matrix character the feed arm will advance the paper in slow feed manner a total of seven times to complete the printing of a line of characters. A line feed arm 30 provides for advancing the printing paper at a line-to-line spacing which would advance the paper in a fast feed manner for the next line of characters. A forms compensation solenoid 32 and a slip or form stop solenoid 34 are provided for their respective functions, although such solenoids and associated apparatus are not a part of the present invention. The bevel gear 20 is secured to one end of a drive shaft 36 for driving an ink ribbon in a cassette which is not shown, but which is normally attached across the front of the solenoids 24 and to the frame of the printer so as to remain in one position as the solenoids 24 are caused to be driven back and forth for printing operations by the drum cam 18. A timing strip 38 is secured to the carriage 22 to be moved back and forth across the printer and operates with a sensing device to provide delayed dot position signals for the printer control logic to actuate the print solenoids 24 at the proper dot column positions.

Figure 2:
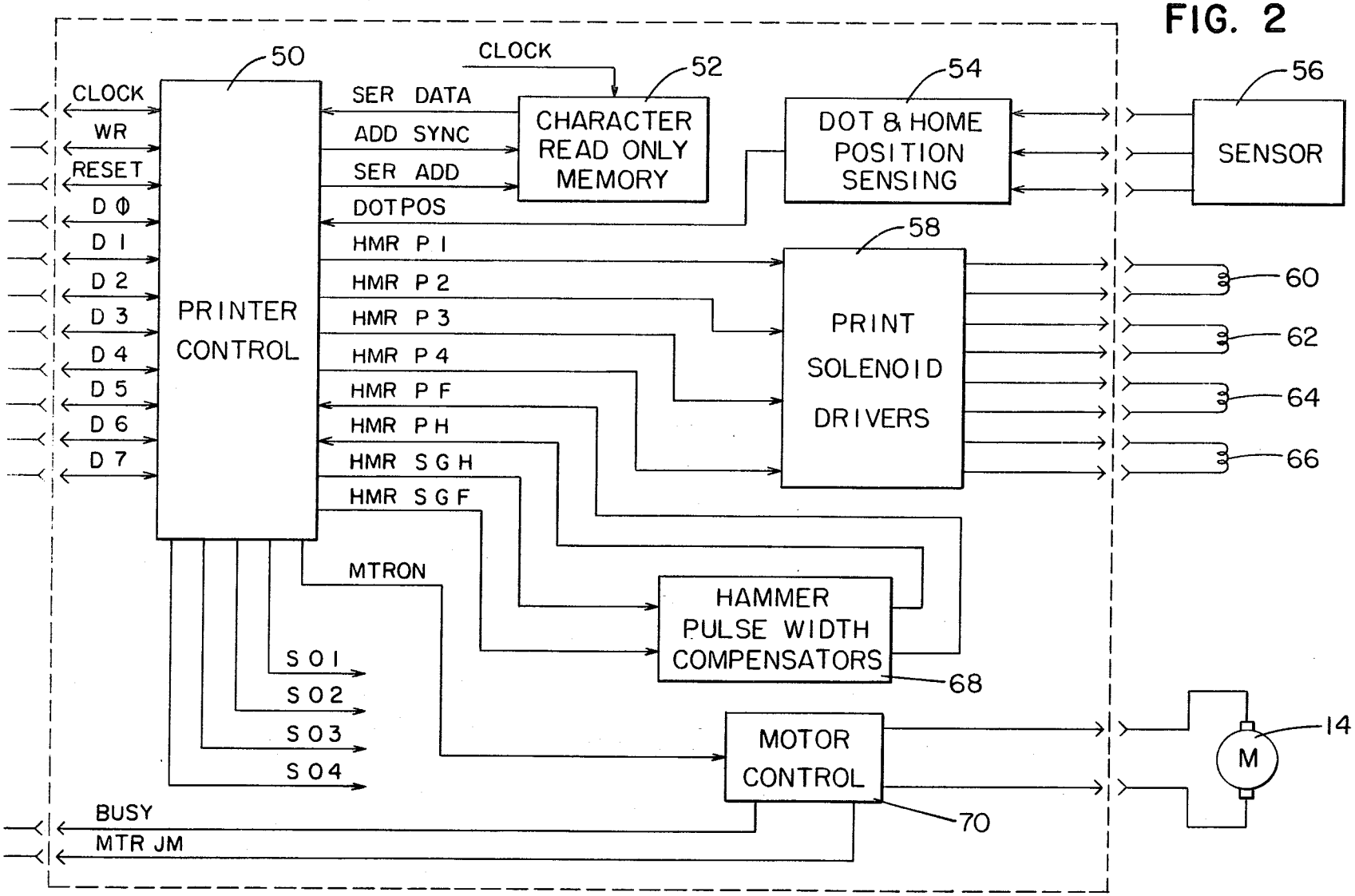
FIG. 2 is a block diagram showing the position sensing and motor control as a portion of the printer control system.

The printer in the present invention is of modular design and is controlled by means of a printer control module 50 as seen in FIG. 2, a character read only memory module 52, a dot and home position sensing circuit 54 and a dot position sensor 56. The printer control module 50 includes at least four main sections or areas which are a memory unit, a pair of programmable logic units and a plurality of serial in/serial out dot data registers for operation from a single phase external clock arranged to provide storage for 40 print characters plus control and control options to implement print control of the 40 column printer. Five control pins provide general purpose drivers and fast slew for the record paper. A full description of the structure and operation of the print control module 50 is disclosed in a copending application, Ser. No. 869,888, filed Jan. 16, 1978 and assigned to the same assignee as the present invention. Additionally, the character read only memory module 52 comprises a diffused mask programmable array of 128 character locations in a twelve by ten matrix, as fully disclosed in the copending application. The hammer pulse width compensators, signified as 68, are two in number for providing adequate activation time for the print solenoids to print full and half dots independently, and each comprise a one-shot timer of standard 340 microsecond pulse, also disclosed in such copending application. The solenoid drivers, designated as 58, are Darlington transistors having a fail-safe mechanism implemented therein in the form of a reset circuit to protect from incorrect operation during power-up and power-down periods. Additional circuitry includes print solenoid drivers 58 for the print wire solenoid coils 60, 62, 64 and 66. The basic control diagram also includes hammer pulse width compensators 68, and a motor control circuit 70 for the motor 14.

Figure 3:
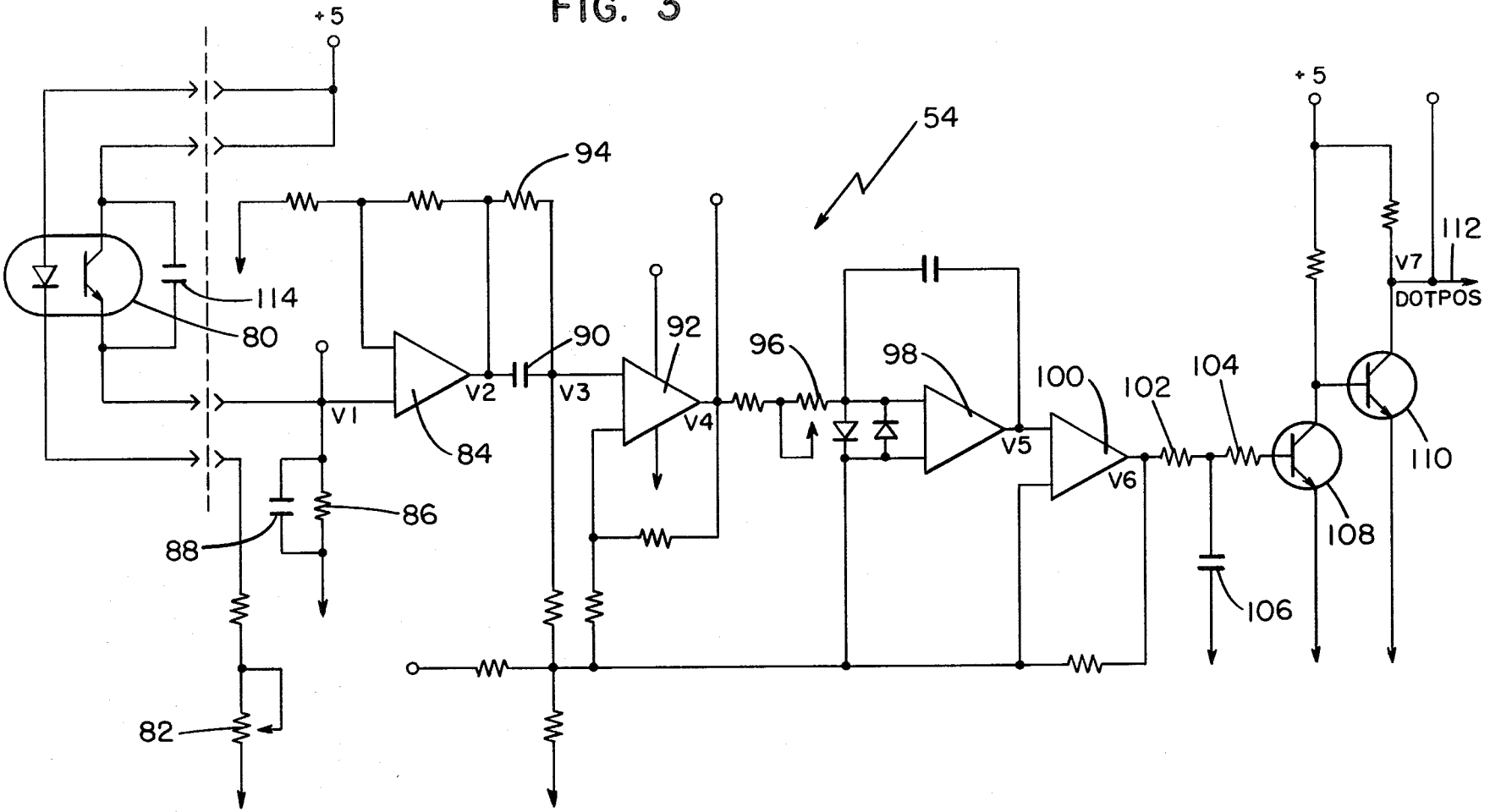
FIG. 3 is a schematic diagram of the character dot and home position sensing circuit.

In FIG. 3 is shown the dot and home position sensing circuit 54 of FIG. 2, which includes a light emitting diode/photo transistor pair sensor 80 of a double mask interruptive type for the purpose of sensing both the edges of slots in the timing strip 38 and also for sensing the home positions of the carriage 22. The sensing scheme consists basically of the sensor 80, a quad operational amplifier, the timing strip 38, and a pair of transistors. As will be further described and shown, the timing strip includes a plurality of slots across the printer and also includes a home 1 position and a home 2 position, the home 1 being a window or light area at the left side of the timing strip, and the home 2 being a dark or blank area at the right side of the timing strip, the home positions being different to control dot sequences.

The circuit 54 of FIG. 3 is identified as an alternating current coupled dot column sensing circuit and provides delayed dot position (DOTPOS) signals for the printer control logic to fire the print solenoids at the proper dot column positions. These dot position signals constitute symmetrical square waveforms which correspond to the timing strip pattern which interrupts the sensor 80. The circuit provides an adjustable time delay to compensate for the response time of the print solenoids 24 for aligning the dot columns in both forward and reverse printing directions. As shown in FIG. 3, a variable resistor 82 is utilized to set a peak voltage of approximately 1 volt input (V1) to a pre-amplifier 84 having a gain of six. A resistor 86 and a capacitor 88 form a low pass filter which attenuates high frequency noise above a predetermined frequency. The amplified output of device 84 (V2) is input through a capacitor 90 to a comparator amplifier 92, the output (V4) of which produces a symmetrical pulse train to a subsequent operational amplifier 98. The capacitor 90 is an alternating current coupling capacitor which passes only those narrow dot column sine waves whereas a resistor 94 couples to the amplifier 92 the longer or wider direct current home level signals. The output of amplifier 92 (V4) is connected through an adjustable resistance or potentiometer 96 to the amplifier 98 which is an integrator type device with an adjustable rate as set by the variable resistance 96. The potentiometer 96 is utilized to provide an adjustable delay in the circuit and may be of the type as produced by CTS Company under Part No. 3605254B. The up and down rates are made equal by setting a bias voltage to one half of the peak output voltage from the amplifier 84.

The output of amplifier 98 (V5) is input to an amplifier 100, which is a comparator device and whose output pulses can be delayed over a range of microseconds with respect to the signal output of the amplifier 92. The output pulses of amplifier 100 (V6) are filtered by a network comprising resistors 102 and 104 and capacitor 106 to mask any possible transients which may be caused by electromagnetic interference. A pair of transistors 108 and 110 are connected in a manner wherein the transistor 110 reduces the rise and fall time and increases the signal level of a dot position (DOTPOS) signal 112 (V7) to meet the requirement for driving the metal oxide semiconductor device and wherein the typical rise and fall times of the dot position signal are 500 nanoseconds.

A capacitor 114 is connected directly under the sensor 80 to prevent transient pulses which may be caused by electromagnetic interference. As will be further seen, a fixed delay of 35 microseconds is provided from the output of amplifier 92 to an edge of one slot of the timing strip 38 and is due to the leading power factor of the alternating current coupling and the light emitting diode sensor response time. A delay time of from 50 to 150 microseconds is provided at the output of comparator amplifier 100 with respect to the output of amplifier 92, the delay being adjustable with respect to the output pulses of the amplifier 92. The network which filters the pulse from amplifier 100 further delays the signal and provides a ten microsecond delay time, so that the total delay time at V7 is in the range of 95 to 195 microseconds.

Figure 4:
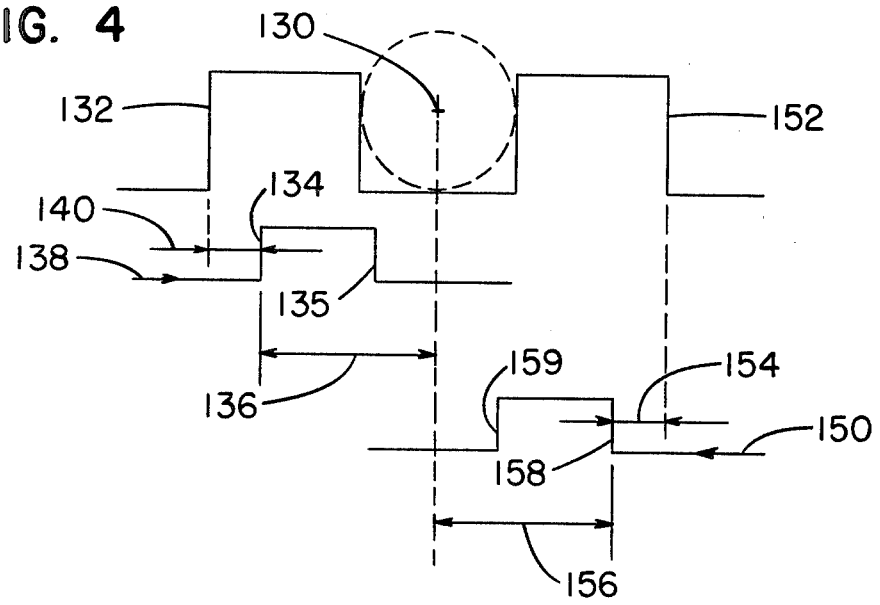
FIG. 4 is a diagram showing a dot column location with delay times in bi-directional printing.

In FIG. 4 is shown a diagram of a dot column position indicated at 130 and which position must be impacted at the precise location by the print wire regardless of the direction of travel of the printing carriage 22. In this manner, when the time represented by the position 130 arrives, there must be a certain delay implemented into the circuit so that the print solenoid is fired at the time represented by the line 134, which time occurs after the sensing of a slot leading edge of the timing strip 38 as represented by the line 132, the line 134 being the hammer pulse for carriage travel in the left to right direction. The response time of the print solenoid is represented by the arrow 136 when the carriage is traveling from left to right or in the direction represented by the arrow 138, the delay time being represented by the arrow 140 which is an adjustable time. A hammer pulse time of 340 microseconds is represented by the lines 134 and 135. Likewise, when the carriage is traveling from right to left, or in the direction represented by the arrow 150, it is seen that when the time arrives at a slot leading edge in the timing strip 38 as represented by the line 152 that an adjustable delay time as represented by the arrow 154 is provided to account for the response time represented by the arrow 156 which is the time between the actuation of the print solenoid and the time of depositing or striking the print wire. The adjustable delay time is indicated by the arrow 154 and is the difference in time of arrival of the line 152 and the time as represented by the line 158 which takes into account the response time of the solenoid as indicated by the line 156 to deposit the print wire at the precise position or dot location 130. The hammer pulse time of 340 microseconds is represented by the lines 158 and 159.

Figure 5:
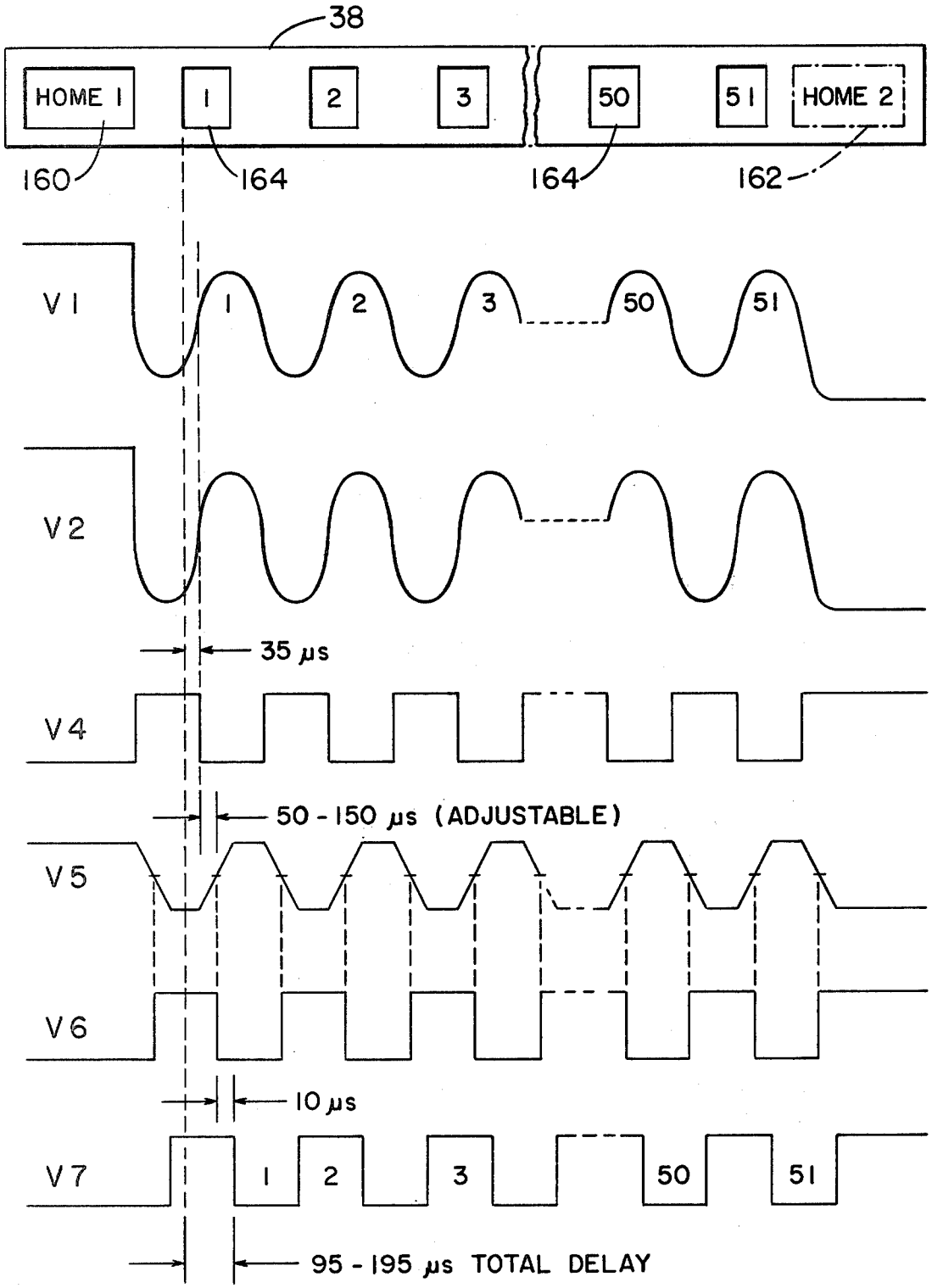
FIG. 5 is a timing diagram of the character dot and home position sensing.

The timing diagram of the dot and home position sensing and the pattern of the timing strip 38 is shown in FIG. 5. The HOME 1 position is a window or light area 160 at the left end of the timing strip, with the HOME 2 position being represented by a web or dark area 162 at the right side of the timing strip. A plurality of slots 164 are included in the timing strip 38, it being seen of course that the illustration in FIG. 5 is greatly enlarged and that there are a total of 51 slots across the timing strip. The timing strip provides for 100 dot columns per print solenoid 24 (requiring 100 aperture or slot edges) and the 51st slot is required for providing an adjustable electronic delay in the print solenoid, the purpose of the delay being to adjust the horizontal position of the dots in columns. The voltages V1, V2, V4, V5, V6 and V7 correspond to the locations of the several voltages in FIG. 3 wherein it can be seen that the output of amplifier 84 is the voltage V2 and that the pulse at the output of amplifier 92 is the voltage V4 and is delayed a period of 35 microseconds (FIG. 5). Likewise, the output of amplifiers 98 and 100 are shown as the pulses V5 and V6 and wherein the delay time at voltage V6 is adjustable from 50 to 150 microseconds, that is in the range between 50 and 150 microseconds. And, finally, the output of the dot position signal at voltage V7 is delayed 10 microseconds to provide the proper timing with a total delay of from 95–195 microseconds for firing the solenoids for the print wires.

Figure 6:
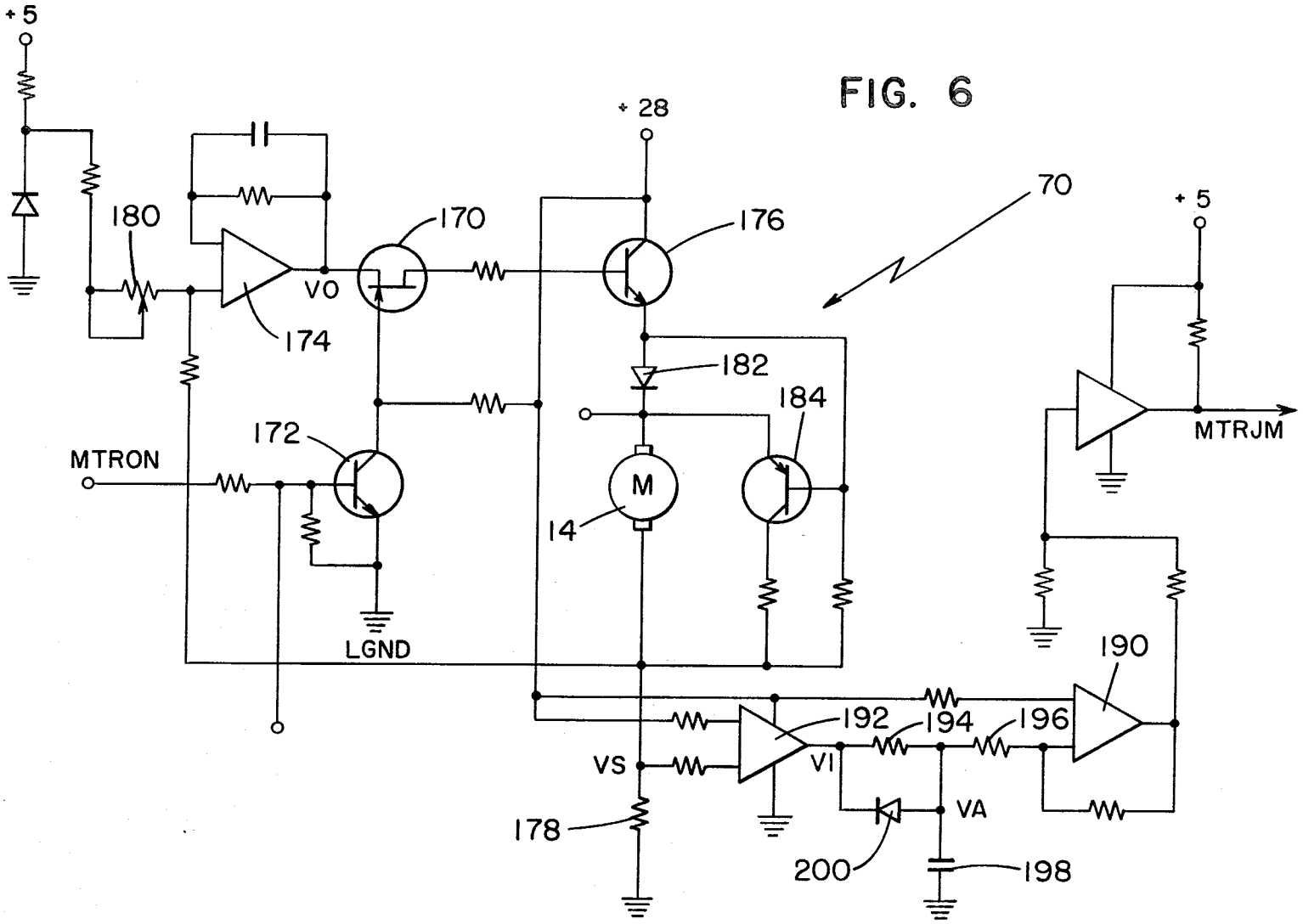
FIG. 6 is a schematic diagram of the motor control circuit.

Closely associated with the dot and home position sensing circuit 54 (FIGS. 2 and 3) for establishing the timing for actuating the print wires in order to impact in the precise dot columns regardless of the direction of printing is the control 70 (FIGS. 2 and 6) for the motor 14 which includes speed regulation, starting of the motor, dynamic braking and a motor jam warning. As seen in FIG. 6, the motor 14 is turned on by a junction field effect transistor 170, the gate of which transistor is controlled by a transistor 172 so that when the motor on signal (MTRON) is high, the transistor 172 reaches a saturated state and the transistor 170 will be cut off by reason of the voltage exceeding the pinch voltage of the transistor 170. At the moment that the motor on signal (MTRON) goes low, the transistor 172 turns off and the transistor 170 will be conducting, at which time the motor is under a speed regulation with the starting time of the motor being approximately 50 milliseconds.

The speed regulation scheme can be termed a back electromotive force direct current motor speed control and is achieved through a feedback operational amplifier 174, a power transistor 176 and a load current sensing resistor 178. By reason of the fact that the amplifier 174 is supplied directly from a 28 volt supply, the amplifier 174 must be a high voltage rated device and it is therefore referred to as a high voltage drive.

When the load on the motor shaft is increased, the armature current increases which likewise increases the resistor 178 voltage drop or $V_s$ and also increases the output voltage $V_o$. A compensation for this is the result of the increase in the voltage which compensates for the lost energy of the back electromotive force due to the current and resistance drop in the motor wherein the speed of the motor is restored back to a normal condition. An adjustable resistor in the form of a potentiometer 180 is used for controlling a fixed amount of current which is introduced into the non-inverting terminal of amplifier 174 and which determines the specified speed of the motor.

A few of the parameters introduced into the speed regulation include the no load speed of the motor which is rated 5400 rpm when the power supply is at 28 volts. At full load, the speed drops 300 rpm or 5.5%, the full load being defined at 0.7 ounce inches of torque. The change in speed is within ±5% over a power supply tolerance from 23.8 to 31.0 volts. While at the lower end of the supply voltage, which would be 23.8 volts, the speed regulation is only effective up to 0.9 ounce inches of torque, normal speed regulation can reach to 1.5 ounce inches of torque, which is approximately twice the rated full load.

Figure 7:
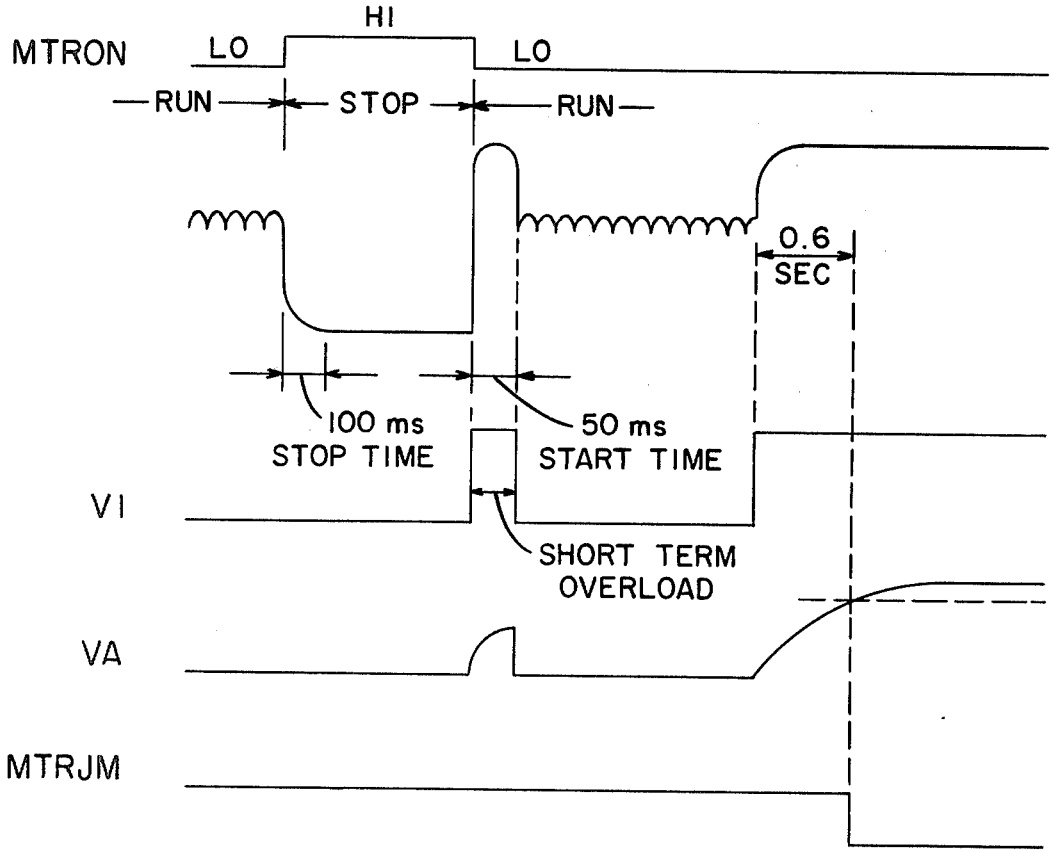
FIG. 7, on the sheet with FIG. 4, is a timing diagram of the motor control.

The dynamic braking of the motor 14 is automatically engaged by the diode 182 (FIG. 6) and the transistor 184 which work in combination in a manner wherein while the motor is running the diode 182 is forward biased which guarantees that the transistor 184 will be cut off. At the time that the transistor 176 is cut off, the diode 182 will no longer conduct, and the transistor 184 will be turned on due to the back electromotive force of the running motor. As a result, the motor can be brought to a full stop within 100 milliseconds as seen in FIG. 7 which shows the starting time as being 50 milliseconds in relation to the stopping time.

When the printer is in normal operation, the output from a motor jam detector 190, in the form of an operational amplifier (FIG. 6), is low because the inverting terminal of such operational amplifier 190 is connected to the supply voltage. When the motor 14 is accidentally jammed or when the armature current exceeds the normal loading, the $V_s$ voltage goes above 2.5 volts and this causes an amplifier 192 to be turned on or wherein the voltage V1 reaches the supply voltage. A network comprising two resistors 194 and 196 and a capacitor 198 forms a delay circuit which has a time constant of approximately 600 milliseconds. When the motor is continuously jammed for approximately 0.6 seconds as shown in FIG. 7, the amplifier 190 will be turned on, and as a result, the motor jam signal becomes active low to warn the user to stop the motor immediately. A diode 200 (FIG. 6) provides a fast discharge path for the voltage $V_a$ so that a short term overload of the motor will not be recognized as a motor jam, which is illustrated in FIG. 7.

It is thus seen that herein shown and described is a delay circuit for controlling the carriage of the print wires of a matrix printer and for taking into consideration the response time of the solenoids for firing the print wires. The control circuit provides for a correct dot and home position for impacting the print wires at the precise dot column in each direction of printing operation. The circuitry as shown and described enables the accomplishment of the objects and advantages mentioned above and while one embodiment of the invention has been disclosed herein, variations thereof beyond those herein mentioned may occur to those skilled in the art. As mentioned above, the printing elements include droplets of ink as distributed from jet nozzles, print wires attached to solenoids, or other like dot-making elements. It is contemplated that all such variations not departing from the spirit and scope of the invention hereof are to be construed in accordance with the following claims.

What is claimed is:

1. Apparatus for positioning single wire printing elements in precise position in bi-directional matrix printing, comprising a carriage carrying said printing elements for bi-directional movement, cam means operably connected with said carriage for moving said printing elements in one and the other direction, a plurality of solenoids on said carriage and having a response time for operating said printing elements for printing in dot row manner, a timing member caused to be moved with said printing elements in said one and the other direction, said timing member having indicia indicating column positions of dot portions of a character, and spaced areas comprising a light area at one end of said timing member and a dark area at the other end thereof indicating end positions of travel of said printing elements, a sensing member positioned in relation to and operable with said movable timing member to sense and respond to said spaced light and dark areas thereof to indicate the one and the other direction of movement of said printing elements and to respond to said indicia thereof for causing said printing elements to be operated for printing, and means for delaying the time of moving said printing elements in said one and the other direction in relation to the response time of said solenoids for operating said printing elements at said column positions in dot row printing manner.

2. The apparatus of claim 1 wherein said timing member comprises a timing strip having a window therein signifying one end or home position of the printing elements and a web area signifying the other end or home position of the printing elements, and includes a plurality of slots in said timing strip between the window and the web area corresponding to dot column positions of characters and said sensing member comprises a sensor for sensing the home positions to indicate direction of movement of said printing elements, and for sensing leading and trailing edges of said slots for printing in dot column alignment in said one and the other direction, one of said slots sensed for aligning the dot portions of a character upon reversal of said carriage.

3. The apparatus of claim 2 wherein the means for delaying the time of moving the printing elements on the carriage in relation to the response time of said solenoids includes comparator and integrator devices for delaying the signals from the detection of one edge of the apertures on said timing member by said sensing member.

4. The apparatus of claim 3 wherein said means for delaying the time of moving the carriage in relation to the response time of said solenoids includes an adjustable pulse delay device operable with said comparator and integrator devices for providing delay in the range of 50 microseconds to 150 microseconds.

5. In a printer having a carriage reciprocable thereacross, a plurality of solenoids supported from said carriage for driving printing elements in dot matrix printing of characters, means for positioning the dots in precise columns during bi-directional printing, comprising a timing member secured to said carriage and movable therewith, a sensor on said printer and operably associated with said timing member, said timing member having indicia indicating dot column positions with carriage home positions comprising a light area at one end of said timing member and a dark area at the other end thereof, said sensor generating pulses from sensing said indicia corresponding to the dot columns of characters to be printed, and sensing the light and dark area home positions of said timing member indicating the direction of movement of said carriage, and means for delaying the time of movement of said carriage upon detecting said indicia in relation to the response time of said solenoids after actuation thereof.

6. In the printer of claim 5 wherein said timing member is a strip having a plurality of slots therein and extending laterally with said carriage and the carriage home positions are defined by a window at one end of said strip and a web area at the other end, one of said slots sensed for aligning the dot portions of a character upon reversal of said carriage.

7. In the printer of claim 5 wherein said means for delaying the time of movement of said carriage in relation to the response time of said solenoids comprises comparator and integrator devices for delaying the signals from the sensing of the indicia on said timing means.

8. In the printer of claim 7 wherein said means for delaying includes an adjustable pulse delay device operable with the comparator and integrator devices for providing delay in the firing of said solenoids in a delay range of 50 microseconds to 150 microseconds.

9. In the printer of claim 5 wherein each of said solenoids includes a single print wire secured thereto and aligned in a plane across said printer and are operated to drive said printing elements in character by character lines of dots for printing a line of characters.

10. Apparatus for controlling the firing of print wire solenoids in a dot matrix printer comprising a print head carriage, cam means for moving said carriage reciprocably across said printer for printing in bi-directional manner, a timing member carried by said carriage, said timing member having a plurality of apertures therein and spaced in a manner coinciding with dot column positions across said printer and including indicia of light area at one end of said timing member and of dark area at the other end thereof representing non-printing margins for indicating end positions of travel of said carriage, a sensor for sensing said apertures to provide a pulse for each dot in a column to be printed and for sensing the light and dark area indicia to indicate direction of travel of said carriage and initiate reversal thereof to provide spacing between lines of dots and of characters, and means for delaying the firing of said solenoids pursuant to the dot column positions in relation to the response time of solenoid firing.

11. The apparatus of claim 10 wherein said timing member comprises a strip having slots therein and said indicia comprises a window at one end of said strip and a web area at the other end thereof for indicating home positions of said carriage and said sensor senses the window and the web area for initiating reversal of said carriage and senses the leading and the trailing edges of said slots for printing in dot column alignment in each direction of travel.

12. The apparatus of claim 11 wherein said delaying means comprise integrator and comparator devices for delaying the signal from the sensing of one edge of said slots on said timing strip.

13. The apparatus of claim 10 wherein said delaying means includes an adjustable pulse delay device operable for providing delay in the firing of said solenoids in the range of 50 microseconds to 150 microseconds.

* * * * *